US010257634B2

(12) United States Patent
Hess et al.

(10) Patent No.: US 10,257,634 B2
(45) Date of Patent: Apr. 9, 2019

(54) APPARATUS AND METHOD FOR PROCESSING STEREO SIGNALS FOR REPRODUCTION IN CARS TO ACHIEVE INDIVIDUAL THREE-DIMENSIONAL SOUND BY FRONTAL LOUDSPEAKERS

(71) Applicant: Fraunhofer-Gesellschaft zur Foerderung der angewandten Forschung e.V., Munich (DE)

(72) Inventors: Wolfgang Hess, Karlsbad (DE); Oliver Hellmuth, Budenhof (DE); Stefan Varga, Cologne (DE); Emanuel Habets, Spardorf (DE); Jan Plogsties, Fuerth (DE); Juergen Herre, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/711,876

(22) Filed: Sep. 21, 2017

(65) Prior Publication Data

US 2018/0014138 A1 Jan. 11, 2018

Related U.S. Application Data

(63) Continuation of application No. PCT/EP2016/056618, filed on Mar. 24, 2016.

(30) Foreign Application Priority Data

Mar. 27, 2015 (EP) ..... 15161402

(51) Int. Cl.
*H04S 5/00* (2006.01)
*H04S 5/02* (2006.01)

(52) U.S. Cl.
CPC ..... *H04S 5/02* (2013.01); *H04S 5/005* (2013.01); *H04R 2499/13* (2013.01); *H04S 2400/01* (2013.01)

(58) Field of Classification Search
CPC ..... H04S 5/02; H04S 5/005; H04S 2400/01; H04S 2400/05; H04S 1/002; H04R 2499/13
(Continued)

(56) References Cited

U.S. PATENT DOCUMENTS 5,459,790 A 10/1995 Scofield et al.
5,999,630 A 12/1999 Iwamatsu
(Continued)

FOREIGN PATENT DOCUMENTS

CN 101002505 A 7/2007
CN 101842834 A 9/2010
(Continued)

OTHER PUBLICATIONS

PCT/EP2016/056618 International Preliminary Report on Patentability, dated Jul. 7, 2017.*
(Continued)

*Primary Examiner* — Ahmad F. Matar
*Assistant Examiner* — Sabrina Diaz
(74) *Attorney, Agent, or Firm* — Perkins Coie LLP; Michael A. Glenn

(57) ABSTRACT

Embodiments provide a digital processor including an ambient portion extractor and a spatial effect processing stage. The ambient portion extractor is configured to extract an ambient portion from a multi-channel signal. The spatial effect processing stage is configured to generate a spatial effect signal based on the ambient portion of the multi-
(Continued)

channel signal. The digital processor is configured to combine the multi-channel signal or a processed version thereof with the spatial effect signal.

20 Claims, 8 Drawing Sheets

(58) Field of Classification Search
USPC ..... 381/302
See application file for complete search history.

(56) References Cited

U.S. PATENT DOCUMENTS

| | | | | |
|---|---|---|---|---|
| 2006/0029239 | A1 | 2/2006 | Smithers | |
| 2010/0232619 | A1 | 9/2010 | Uhle et al. | |
| 2013/0064374 | A1* | 3/2013 | Lee | H04S 3/004 381/17 |
| 2014/0064527 | A1 | 3/2014 | Walther et al. | |
| 2015/0334500 | A1* | 11/2015 | Mieth | H04L 65/601 381/17 |

FOREIGN PATENT DOCUMENTS

| | | | |
|---|---|---|---|
| CN | 103650537 | A | 3/2014 |
| EP | 1280377 | A1 | 1/2003 |
| EP | 1685743 | B1 | 2/2013 |
| RU | 2321187 | C1 | 3/2008 |
| WO | 9325055 | A1 | 12/1993 |
| WO | 2011104146 | A1 | 9/2011 |
| WO | 2014135235 | A1 | 9/2014 |

OTHER PUBLICATIONS

Faller, Christof , "Matrix Surround Revisited", AES 30th International Conference, Mar. 15-17, 2007, pp. 1-7.

Goodwin, Michael M. et al., "Spatial Audio Scene Coding", Audio Engineering Society Convention Paper 7507 Presented at the 125th Convention, Oct. 2-5, 2008, pp. 1-8.

Hess, W. et al., "Replication of Human Head Movements in 3 Dimensions by a Mechanical Joint", in Proc. ICSA International Conference on Spatial Acoustics, Erlangen, Germany, 2014, 8 pages.

Jecklin, J. , "A different way to record classical music", J. Audio Eng. Soc, vol. 29, No. 5, May 1981, pp. 329-332.

Kowalczyk, Konrad et al., "Parametric Spatial Sound Processing: A flexible and efficient solution to sound scene acquisition, modification, and reproduction", IEEE Signal Processing Magazine, IEEE Service Center, Piscataway, NJ, US, vol. 32, No. 2, Mar. 2015, pp. 31-42.

Lee, Taegyu et al., "Stereo upmix-based binaural auralization for mobile devices", IEEE Transactions on Consumer Electronics, vol. 60, No. 3, Aug. 2014, pp. 411-419.

Pulkki, V. , "Spatial Sound Reproduction with Directional Audio Coding", J. Audio Engineering Society, vol. 55, No. 6, Jun. 2007, pp. 503-516.

Walther, Andreas et al., "Direct-Ambient Decomposition and Upmix of Surround Signals", IEEE Workshop on Application of Signal Processing to Audio and Acoustics (WASPAA), Oct. 16, 2011, pp. 277-280.

* cited by examiner

APPARATUS AND METHOD FOR PROCESSING STEREO SIGNALS FOR REPRODUCTION IN CARS TO ACHIEVE INDIVIDUAL THREE-DIMENSIONAL SOUND BY FRONTAL LOUDSPEAKERS

CROSS-REFERENCE TO RELATED APPLICATIONS

This application is a continuation of copending International Application No. PCT/EP2016/056618, filed Mar. 24, 2016, which is incorporated herein by reference in its entirety, and additionally claims priority from European Application No. EP 15 161 402.1, filed Mar. 27, 2015, which is incorporated herein by reference in its entirety.

Embodiments relate to a digital processor, and specifically, to a digital processor for processing a multi-channel signal, e.g., for three-dimensional sound reproduction in vehicles. Further embodiments relate to a method for processing a multi-channel signal. Some embodiments relate to an apparatus and method for processing a stereo signal for reproduction in cars to achieve individual three-dimensional sound by frontal loudspeakers.

BACKGROUND OF THE INVENTION

Conventionally, a multi-loudspeaker multichannel 3-D sound system consisting of more than 20 loudspeakers is used for three-dimensional sound reproduction in vehicles. Such a multi-loudspeaker multichannel sound system comprises in a front area of the vehicle a center channel loudspeaker, a front right channel loudspeaker and a front left channel loudspeaker. The center channel loudspeaker can be arranged in a center of the dashboard, wherein the front right channel and front left channel loudspeakers can be arranged in the front doors of the vehicle or at outer right and left positions in the dashboard. Further, the multi-loudspeaker multichannel sound system comprises in a rear area of the vehicle a rear right (or surround right) channel loudspeaker and a rear left (or surround left) channel loudspeaker. The rear right and rear left channel loudspeakers can be arranged in the rear doors of the vehicle or at outer right and left positions in a rear shelf of the vehicle. Optionally, the multi-loudspeaker multichannel system can comprise at least one subwoofer. However, a conventional multi-loudspeaker multichannel 3-D sound system involves a high cabling effort and a high number of power amplifiers. Further, a complex audio processing is involved in order to obtain the signals for the different channels of the multi-loudspeaker multichannel sound system based on a stereo signal.

SUMMARY

According to an embodiment, a digital processor for a loudspeaker reproduction system with at least three front loudspeakers may have: an ambient portion extractor configured to extract an ambient portion from a multi-channel signal; and a spatial effect processing stage, configured to generate a spatial effect signal based on the ambient portion of the multi-channel signal; wherein the digital processor is configured to combine a processed version of the multi-channel signal with the spatial effect signal, to obtain a signal for the at least three front loudspeakers; wherein the digital processor has a multi-channel processing stage configured to generate the processed version of the multi-channel signal; wherein the digital processor is configured to combine the processed version of the multi-channel signal and the spatial effect signal; wherein the multi-channel signal is a stereo signal; and wherein the processed version of the multi-channel signal has at least one more channel than the multi-channel signal; wherein the multi-channel processing stage is configured to generate an individual stereo sound stage signal as the processed version of the multi-channel signal from the stereo signal for generating with the loudspeaker reproduction system having the at least three loudspeakers at least two individual stereo sound stages for at least two different listening positions.

According to another embodiment, a loudspeaker reproduction system for a vehicle may have: an inventive digital processor; at least three front loudspeakers configured to reproduce a signal obtained by the combining of the multi-channel signal or the processed version thereof and the spatial effect signal.

According to another embodiment, a method for processing signals for a loudspeaker reproduction system with at least three front loudspeakers may have the steps of: extracting an ambient portion from a multi-channel signal; and generating a spatial effect signal based on the ambient portion of the multi-channel signal; and generating a processed version of the multi-channel signal; combining the processed version of the multi-channel signal with the spatial effect signal, to obtain a signal for the at least three front loudspeakers; wherein the multi-channel signal is a stereo signal; wherein the processed version of the multi-channel signal has at least one more channel than the multi-channel signal; and wherein generating the processed version of the multi-channel signal has generating an individual stereo sound stage signal as the processed version of the multi-channel signal from the stereo signal for generating with the loudspeaker reproduction system has the at least three loudspeakers at least two individual stereo sound stages for at least two different listening positions.

Another embodiment may have a non-transitory digital storage medium having a computer program stored thereon to perform the method for processing signals for a loudspeaker reproduction system with at least three front loudspeakers, the method having the steps of: extracting an ambient portion from a multi-channel signal; and generating a spatial effect signal based on the ambient portion of the multi-channel signal; and generating a processed version of the multi-channel signal; combining the processed version of the multi-channel signal with the spatial effect signal, to obtain a signal for the at least three front loudspeakers; wherein the multi-channel signal is a stereo signal; wherein the processed version of the multi-channel signal has at least one more channel than the multi-channel signal; and wherein generating the processed version of the multi-channel signal has generating an individual stereo sound stage signal as the processed version of the multi-channel signal from the stereo signal for generating with the loudspeaker reproduction system having the at least three loudspeakers at least two individual stereo sound stages for at least two different listening positions, when said computer program is run by a computer.

Embodiments provide a digital processor comprising an ambient portion extractor and a spatial effect processing stage. The ambient portion extractor is configured to extract an ambient portion from a multi-channel signal. The spatial effect processing stage is configured to generate a spatial effect signal based on the ambient portion of the multi-channel signal. The digital processor is configured to combine the multi-channel signal or a processed version thereof with the spatial effect signal.

According to the concept of the present invention, the spatial effect audio processing stage can be configured to perform spatial effect audio processing on the ambient portion of the multi-channel signal in order to add a spatial effect (e.g., at least one out of auditory stage dimension and auditory envelopment) to the individual multi-channel sound stage signal by combining the individual multi-channel sound stage signal and the spatial effect signal.

Further embodiments relate to a method comprising:

extracting an ambient portion from a multi-channel signal;

generating a spatial effect signal based on the ambient portion of the multi-channel signal; and combining the multi-channel signal or a processed version thereof with the spatial effect signal.

Advantageous implementations are addressed in the dependent claims.

In embodiments, the multi-channel (audio) signal can comprise two or more, i.e. at least two, (audio) channels. For example, the multi-channel (audio) signal can be a stereo signal.

In embodiments, the digital processor can comprise a multi-channel processing stage configured to process the multi-channel signal, to obtain a processed version of the multi-channel signal. Thereby, the digital processor can be configured to combine the processed version of the multi-channel signal and the spatial effect signal.

The multi-channel processing stage can be configured to generate an individual multi-channel sound stage signal (=processed version of the multi-channel signal) based on the multi-channel signal. The individual multi-channel sound stage signal may comprise at least one more channel than the multi-channel signal. The individual multi-channel sound stage signal can be used for generating, e.g., with a loudspeaker reproduction system, at least two individual multi-channel sound stages for at least two different listening positions.

For example, the multi-channel processing stage can be configured to generate an individual stereo sound stage signal based on the stereo signal for generating, e.g., with a loudspeaker reproduction system comprising at least three loudspeakers (e.g., three or four loudspeakers), at least two individual stereo sound stages for at least two different listening positions.

In embodiments, the spatial effect processing stage can comprise a binauralization stage configured to apply spatial binaural filters (or binaural filters adapted to enhance an auditory stage dimension, e.g., at least one out of auditory stage width and auditory stage height) to the ambient portion of the multi-channel signal or a processed version thereof.

The spatial binaural filters may correspond to direct sound path impulse responses.

For example, the binaural filters may correspond to impulse responses of sound paths between a listening position (or a listener (e.g., ears of a listener), e.g., represented by a dummy head with one or more microphones placed or arranged at the listening position) and at least two audio sources (e.g., loudspeakers) placed or arranged at different positions with respect to the listening position. The binaural filters can be obtained, for example, by measuring impulse responses of the two audio sources placed in a stereo triangle of at least two out of 30°, 40°, 50°, 60°, 70°, 80°, 90°, 100°, 110° and 120° with respect to the listening position and determining a convolution of the measured impulse responses.

The binauralization stage can be configured to apply the same binaural filter or binaural filters to channels of the ambient portion of the multi-channel signal or the processed version thereof corresponding to different listening positions.

In embodiments, the spatial effect processing stage can comprise a listener envelopment modifier configured to apply listener envelopment binaural filters (or binaural filters adapted to enhance an auditory envelopment (of the listener)) to the ambient portion of the multi-channel signal or a processed version thereof.

The listener envelopment binaural filters may correspond to binaural room impulse responses.

For example, the binaural filter may correspond to an impulse response of a room surrounding (e.g., aside and/or behind) a listening position (or a listener (e.g., ears of a listener), e.g., represented by a dummy head with one or more microphones placed or arranged at the listening position). The binaural filter can be obtained, for example, by measuring an impulse response between at least one audio source (e.g., loudspeaker) placed aside or behind the listening position.

The listener envelopment modifier can be configured to apply different binaural filters to channels of the multi-channel signal or the processed version thereof corresponding to different listening positions.

In embodiments, the spatial effect processing stage can comprise a decorrelator configured to decorrelate the ambient portion of the multi-channel signal, to obtain a decorrelated signal.

The decorrelated signal can comprise at least one more channel than the multi-channel signal. For example, the multi-channel signal can be a stereo signal, wherein the decorrelated signal can comprise three or four channels.

The binauralization stage can be configured to apply the spatial binaural filters to the decorrelated signal or a processed version thereof (e.g., processed by the listener envelopment modifier).

The listener envelopment modifier can be configured to apply the envelopment binaural filters to the decorrelated signal or a processed version thereof (e.g., processed by the binauralization stage).

In embodiments, the spatial effect processing stage can comprise a delay stage configured to delay a processed version of the ambient portion of the multi-channel signal, e.g., processed by at least one out of the binauralization stage and the listener envelopment modifier.

In embodiments, the spatial effect processing stage can comprise a spatial effect strength adjusting stage configured to adjust a spatial effect strength of a processed version of the ambient portion of the multi-channel signal, e.g., processed by at least one out of the binauralization stage and the listener envelopment modifier.

In embodiments, the spatial effect processing stage can comprise an auditory stage dimension effect adjusting stage configured to adjust an auditory stage dimension effect strength of a processed version of the ambient portion of the multi-channel signal, e.g., processed by the binauralization stage.

In embodiments, the spatial effect processing stage can comprise a listener envelopment effect adjusting stage configured to adjust an effect strength of a processed version of the ambient portion of the multi-channel signal, e.g., processed by the listener envelopment modifier.

In embodiments, the spatial effect signal provided by the spatial effect stage can be a processed version of the ambient portion of the multi-channel effect signal processed by at least one out of the binauralization stage and the listener envelopment modifier, and optionally further processed by at least one out of the delay stage and effect adjusting stage (e.g., spatial effect strength adjusting stage, auditory stage dimension effect adjusting stage or listener envelopment effect adjusting stage).

In embodiments, the digital processor can be configured to channel wise combine the multi-channel signal or a processed version thereof with the spatial effect signal.

The digital processor can comprise an adder, configured to channel wise add the multi-channel signal or a processed version thereof with the spatial effect signal.

Further embodiments relate to a loudspeaker reproduction system for a vehicle. The system can comprise the above described digital processor and at least three front loudspeakers configured to reproduce the signal provided by the digital processor.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
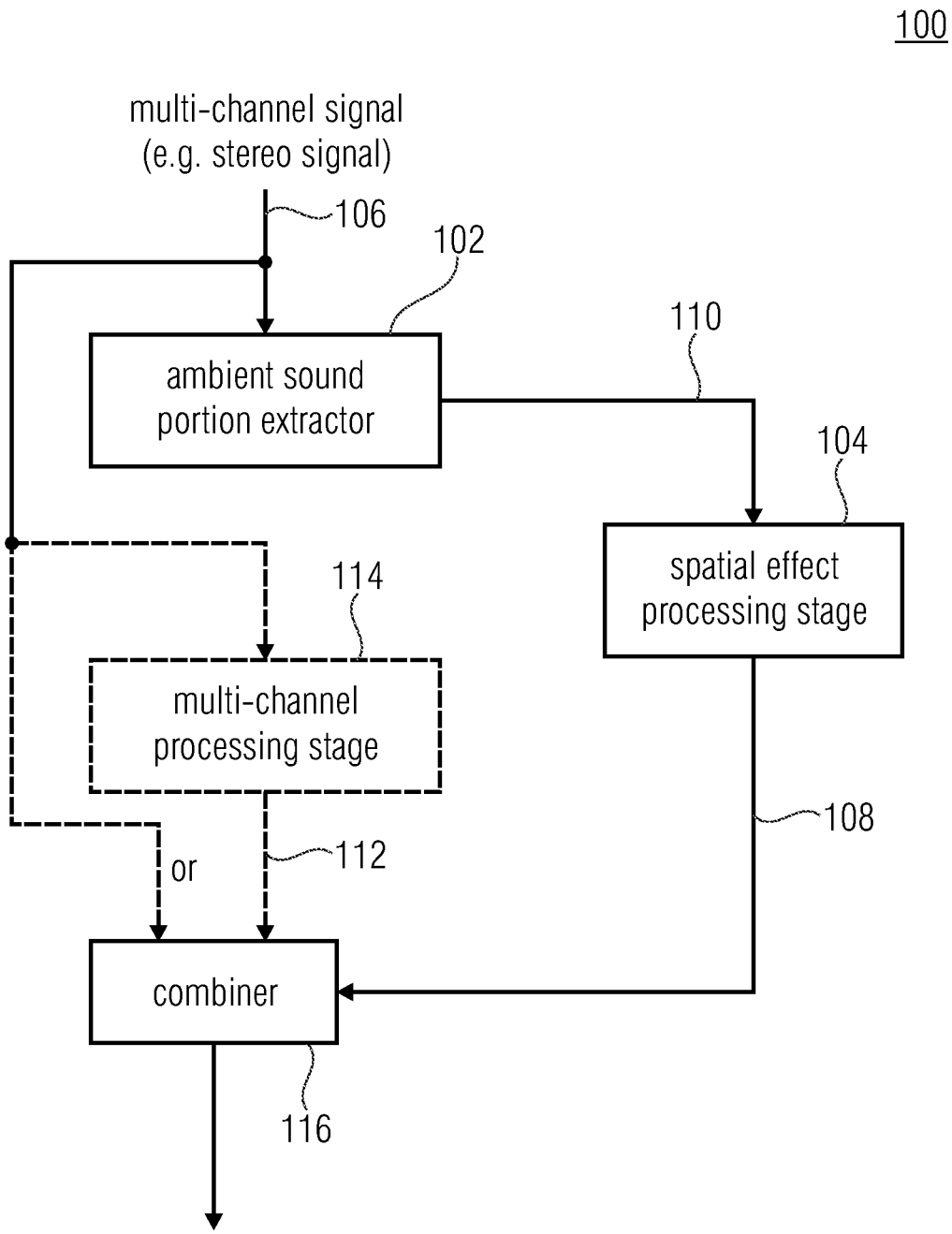
FIG. 1 shows a schematic block diagram of a digital processor according to an embodiment.

Equal or equivalent elements or elements with equal or equivalent functionality are denoted in the following description by equal or equivalent reference numerals.

In the following description, a plurality of details are set forth to provide a more thorough explanation of embodiments of the present invention. However, it will be apparent to one skilled in the art that embodiments of the present invention may be practiced without these specific details. In other instances, well-known structures and devices are shown in block diagram form rather than in detail in order to avoid obscuring embodiments of the present invention. In addition, features of the different embodiments described hereinafter may be combined with each other, unless specifically noted otherwise.

FIG. 1 shows a schematic block diagram of a digital processor 100 according to an embodiment. The digital processor 100 comprises an ambient sound portion extractor 102 and a spatial effect sound processing stage 104. The ambient sound portion extractor 102 is configured to extract an ambient portion from a multi-channel signal 106. The spatial effect sound processing stage 104 is configured to generate a spatial effect signal 108 based on the ambient portion 110 of the multi-channel signal. The digital processor 100 is configured to combine the multi-channel signal 106 or a processed version 112 of the multi-channel signal with the spatial effect signal 108.

As shown in FIG. 1, the digital processor 100 can optionally comprise a multi-channel audio processing stage 114 configured to process the multi-channel signal 106, to obtain the processed version 112 of the multi-channel signal. Thereby, the digital processor 100 can be configured to combine the processed version 112 of the multi-channel signal and the spatial effect signal 108, e.g., using a combining stage 116.

The multi-channel audio processing stage 114 can be configured to generate an individual multi-channel sound stage signal 112 (=processed version of the multi-channel signal) based on the multi-channel signal 106. The individual multi-channel sound stage signal 112 can be used for generating, e.g., with a loudspeaker reproduction system, at least two individual multi-channel sound stages for at least two different listening positions.

The spatial effect audio processing stage 104 can be configured to perform spatial effect audio processing on the ambient portion of the multi-channel signal 106 in order to add a spatial effect (e.g., at least one out of auditory stage dimension and auditory envelopment) to the individual multi-channel sound stage signal 112 by combining the individual multi-channel sound stage signal 112 and the spatial effect signal 108.

Auditory stage dimension (ASD) depicts the combination of auditory stage width (horizontal extent of the sound field in the front of the listener) and auditory stage height (vertical spatial extent of the sound field in front of the listener).

Listener envelopment (LEV) depicts the auditory envelopment (surrounding) by sound of the listener perceived at the side and the rear of the listener.

In the following, embodiments are described which are directed to reproducing a stereo signal in a vehicle. Thereby, the multi-channel processing stage 114 can be configured to generate an individual stereo sound stage signal 112 based on the stereo signal 106 for generating with a loudspeaker reproduction system at least two individual stereo sound stages for at least two different listening positions, i.e., a driver position and a front passenger position.

In detail, reproduction of stereo input signals as three-dimensional sound signals in a vehicle (e.g., car) can be achieved by two loudspeaker pairs mounted in a dashboard in front of the listeners (or three loudspeakers=one center and two loudspeakers mounted near the A-pillar in the dashboard). Auditory spatial extent of the sound stage in front of the listener can be perceived horizontally in width and vertically in height, auditory spatial envelopment is perceived at the side and in the rear, i.e. spatial depth and spatial surrounding is generated.

The basic idea is to overlay a stable state-of-the-art standard stereo sound stage, which also can be reproduced as a (standalone) stereo signal, by ambient sound processing by adding a three-dimensional sound field. Ambient sound information can be calculated from the original stereo signal 106 (by extracting spatial information from the stereo signal), it can be binauralized and spatially shaped by modified measured impulse responses and spectral processing. So at least one out of auditory stage height, auditory stage width and enveloping sound can be processed depending on the mix of the source signal with static digital filters, which can be adjusted for optimal individual spatial perception in stage width and height and envelopment.

After one or more delay stages the strength of the three-dimensional effect can be adjusted (or weighted) before this signal 108 is mixed on top of the stereo sound front stage audio signal 112. An output generation unit may output the signals to two pairs of loudspeakers or three loudspeakers mounted in front of the two front seats in the dashboard of a car.

In the following, a serial processing of the three-dimensional algorithm is described with respect to FIG. 2 and a parallel processing of the three-dimensional algorithm, allowing a better scalability of the three-dimensional sound field, is described with respect to FIG. 3.

Figure 2:
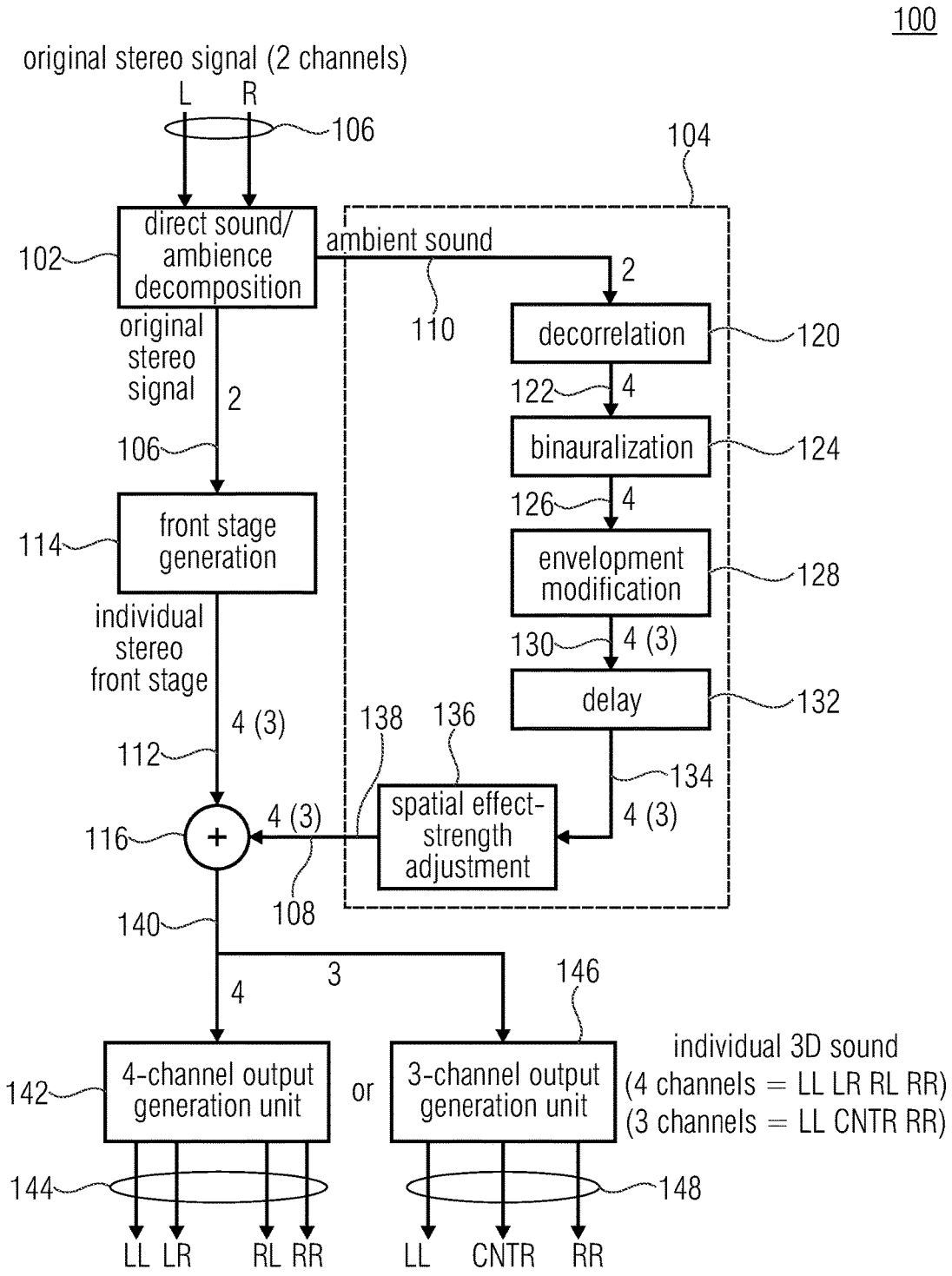
FIG. 2 shows a schematic block diagram of a digital processor according to a further embodiment.

FIG. 2 shows a schematic block diagram of the audio processor 100 according to a further embodiment. The sound processor 100 comprises the ambient sound portion extractor (direct sound/ambience decomposition) 102, the spatial effect processing stage 104 and the combining stage 116.

Decorrelation of the two input channels can be used for both center channels only or also for all four channels. Binauralization for the front stage can be done by measured and tuned binaural room impulse responses, measured in a standard room, e.g. a studio room or a living room.

In detail, as shown in FIG. 2, the spatial effect processing stage 104 can comprise a decorrelator 120 configured to decorrelate the ambient portion 110 of the stereo signal, to obtain a decorrelated signal 122. The decorrelated signal 122 can comprise four channels.

Further, the spatial effect processing stage 104 can comprise a binauralization stage 124. The binauralization stage 124 can be configured to apply spatial binaural filters (or binaural filters adapted to enhance an auditory stage dimension, e.g., at least one out of auditory stage width and auditory stage height) to the ambient portion 110 of the stereo signal or a processed version thereof, e.g., to the decorrelated signal 122 in the embodiment shown in FIG. 2.

The binauralization stage 124 or binauralization block can consist of binaural filters, identical for the driver's seat and the co-driver's seat. Due to identical spatial filters and symmetric loudspeaker positions, the acoustic tuning process is highly simplified since settings for both seats are identical. These binaural filters can be measured acoustically in rooms as described above. For the binauralization stage a standard room or a car can be used for measurement. There two loudspeakers can be placed symmetrically in front of a dummy head mounted on a torso or a user. The impulse responses of those loudspeakers can be measured. These loudspeaker pairs can be placed in a stereo triangle at 30°, 40°, 50°, 60°, 70°, 80°, 90°, 100°, 110° or 120° relative to the frontal direction of the listener. However, also simulated filters generated by a acoustical room simulation can be used. The convolution of these impulse responses in the form of finite impulse response filters (FIRs equivalent to binaural room impulse responses) can be done in the time domain, the frequency domain (overlap-save of overlap-add) or in the QMF-filterbank domain (QMR=quadrature mirror filter), see for filter processing structure FIG. 7.

The processed version 126 of the ambient sound portion 110 of the stereo signal processed by the binauralization stage 124 can comprise at least one more channel than the stereo signal. For example, the signal 126 processed by the binauralization stage 124 can comprise three channels (e.g., for a loudspeaker reproduction system comprising three loudspeakers) or four channels (e.g., for a loudspeaker reproduction system comprising four loudspeakers, or for a further processing).

Further, the spatial effect processing stage 104 can comprise a listener envelopment modifier 128 configured to apply listener envelopment binaural filters (or binaural filters adapted to enhance an auditory envelopment (of the listener)) to the ambient portion 110 of the multi-channel signal or a processed version thereof, e.g., to the signal 126 processed by the binauralization stage 126 in the embodiment shown in FIG. 2.

For the envelopment modifier 128 (or envelopment modification block or envelopment stage) a measurement inside the car measuring impulse responses from loudspeakers behind the listener can be used. In these measurements a dummy head on a torso [Hess, W. and J. Weishäupl, "Replication of Human Head Movements in 3 Dimensions by a Mechanical Joint", in Proc. ICSA International Conference on Spatial Acoustics, Erlangen, Germany, 2014.], a sphere microphone or a baffle [Jecklin, J.: "A different way to record classical music", in J. Audio Eng. Soc, Vol. 29 issue 5 pp., 329-332, 1981] can be used to ensure an audio channel separation of left and right ear measurement channel. In the car, the dummy head or microphone can be placed on the front seat. At each front seat a measurement can be done, so two different binaural room-impulse responses can be measured. One loudspeaker can be measured or a combination of more than one, see FIG. 4. See for the filter processing structure FIG. 7.

The processed version 130 of the ambient sound portion 110 of the stereo signal processed by the envelopment modifier 128 can comprise at least one more channel than the stereo signal.

For example, the signal 126 processed by the envelopment modifier 128 can comprise three channels (e.g., for a loudspeaker reproduction system comprising three loudspeakers) or four channels (e.g., for a loudspeaker reproduction system comprising four loudspeakers, or for a further processing).

Furthermore, the spatial effect processing stage 104 can comprise a delay stage 132 configured to delay a processed version of the ambient portion 110 of the stereo signal, e.g., processed by at least one out of the binauralization stage 124 and the listener envelopment modifier 128, for example, the signal 130 processed by the envelopment modifier 128 in the embodiment shown in FIG. 2.

The processed version 134 of the ambient sound portion 110 of the stereo signal processed by the delay stage 132 can comprise at least one more channel than the stereo signal. For example, the signal 134 processed by the delay stage can comprise three channels (e.g., for a loudspeaker reproduction system comprising three loudspeakers) or four channels (e.g., for a loudspeaker reproduction system comprising four loudspeakers).

Furthermore, the spatial effect processing stage 104 can comprise a spatial effect strength adjusting stage 136 configured to adjust a spatial effect strength of a processed version of the ambient portion 110 of the stereo signal, e.g., processed by at least one out of the binauralization stage 124 and the listener envelopment modifier 128, or a further processed version thereof, for example, the signal 134 processed by the delay stage 134 in the embodiment shown in FIG. 2.

The processed version 138 of the ambient sound portion 110 of the stereo signal processed by the spatial effect strength adjusting stage 136 can comprise at least one more channel than the stereo signal. For example, the signal 138 processed by the spatial effect strength adjusting stage 136 can comprise three channels (e.g., for a loudspeaker reproduction system comprising three loudspeakers) or four channels (e.g., for a loudspeaker reproduction system comprising four loudspeakers, or for a further processing).

The spatial effect signal 108 provided by the spatial effect stage 104 can be a processed version of the ambient portion 110 of the stereo signal processed by at least one out of the binauralization stage 124 and the listener envelopment modifier 128, and optionally further processed by at least one out of the delay stage 132 and spatial effect strength adjusting stage 136, for example, the signal 138 processed by the spatial effect strength adjusting stage 136.

The sound processor 100 can further comprise a stereo processing stage (front stage generation) 114 configured to generate an individual stereo sound stage signal 112 based on the stereo signal 106 for generating with a loudspeaker reproduction system having three or four loudspeakers at least two individual stereo sound stages for at least two different listening positions, i.e., a driver position and a front passenger position.

The individual stereo sound stage signal 112 provided by the stereo processing stage 114 can comprise at least one more channel than the stereo signal. For example, the individual stereo sound stage signal 112 can comprise three channels (e.g., for a loudspeaker reproduction system comprising three loudspeakers) or four channels (e.g., for a loudspeaker reproduction system comprising four loudspeakers).

The combining stage 116, e.g., adder, can be configured to channel-wise combine the individual stereo sound stage signal 112 and the spatial effect signal 108, i.e., the individual stereo sound stage signal 112 and the spatial effect signal 108 can comprise the same number of channels.

The signal 140 provided by the combining stage 116 can comprise at least one more channel than the stereo signal. For example, the signal 140 provided by the combining stage 116 can comprise three channels (e.g., for a loudspeaker reproduction system comprising three loudspeakers) or four channels (e.g., for a loudspeaker reproduction system comprising four loudspeakers).

The sound processor 100 may comprise a four-channel output generation unit 142 configured to generate a four-channel output signal 144 comprising four channels (left left (LL), left right (LR), right left (RL), right right (RR)) (e.g., for a loudspeaker reproduction system comprising four loudspeakers) based on the signal 140 processed by the combining stage 116.

Alternatively, the sound processor 100 may comprise a three-channel output generation unit 146 configured to generate a three-channel output signal 148 comprising three channels (left (LL), center (CNTR), right (RR)) (e.g., for a loudspeaker reproduction system comprising three loudspeakers) based on the signal 140 processed by the combining stage 116.

Figure 3:
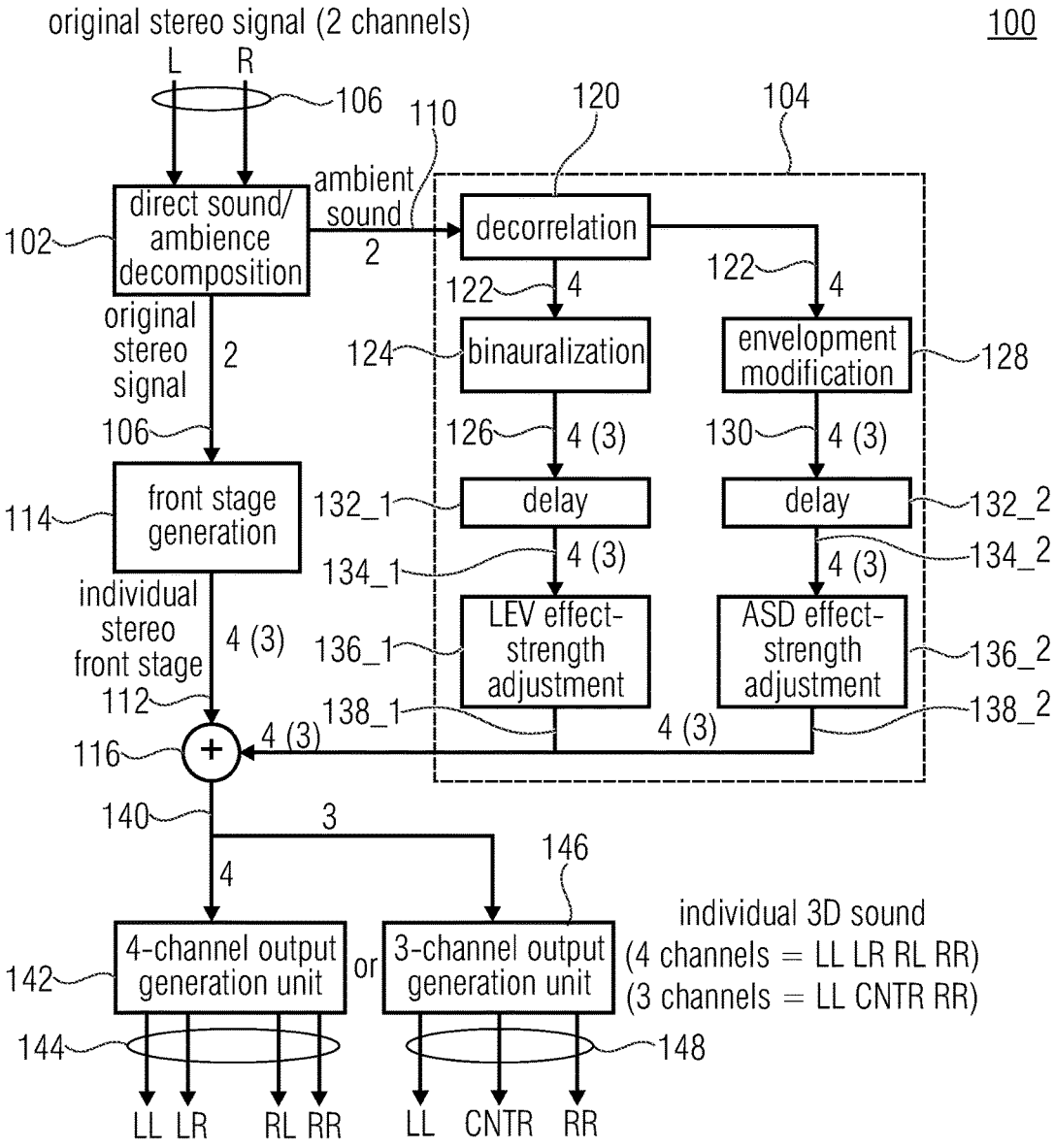
FIG. 3 shows a schematic block diagram of a digital processor according to a further embodiment.

FIG. 3 shows a schematic block diagram of the audio processor 100 according to a further embodiment. The sound processor 100 comprises the ambient sound portion extractor (direct sound/ambience decomposition) 102, the spatial effect processing stage 104 and the combining stage 116.

The direct sound/ambience decomposition unit 102 works as dynamic, input signal dependent processing unit. These algorithms are well known from literature, see e.g. [WALTHER ANDREAS ET AL: "Direct-ambient decomposition and upmix of surround signals", APPLICATIONS OF SIGNAL PROCESSING TO AUDIO AND ACOUSTICS (WASPAA), 2811 IEEE WORKSHOP ON, IEEE, 16 Oct. 2011] and [GAMPP PATRICK ; HABETS EMANUEL ; KRATZ MICHAEL ; UHLE CHRISTIAN: APPARATUS AND METHOD FOR MULTICHANNEL DIRECT-AMBIENT DECOMPOSITION FOR AUDIO SIGNAL PROCESSING, Patent Family number: 57367305 (WO14135235A1), published 20131023]. All following algorithms are of static nature. Only static filters and low latency block convolution (e.g. overlap-add or overlap-save) are used for signal shaping through digital finite impulse response filters in the "Binauralization" and "Envelopment modification" block.

In detail, as shown in FIG. 3, the spatial effect processing stage 104 can comprise a decorrelator 120 configured to decorrelate the ambient portion 110 of the stereo signal, to obtain a decorrelated signal 122. The decorrelated signal 122 can comprise four channels.

Further, the spatial effect processing stage 104 can comprise a binauralization stage 124. The binauralization stage 124 can be configured to apply spatial binaural filters (or binaural filters adapted to enhance an auditory stage dimension, e.g., at least one out of auditory stage width and auditory stage height) to the ambient portion 110 of the stereo signal or a processed version thereof, e.g., to the decorrelated signal 122 in the embodiment shown in FIG. 3.

The binauralization stage 124 or binauralization block can consist of binaural filters, identical for the driver's seat and the co-driver's seat. These filters can be measured acoustically in rooms as described above. For the binauralization stage a standard room can be used for measurement. There two loudspeakers can be placed symmetrically in front of a dummy head mounted on a torso or a user. The impulse responses of those loudspeakers can be measured. These loudspeaker pairs can be placed in a stereo triangle at 30°, 40°, 50°, 60°, 70°, 80°, 90°, 100°, 110° or 120° relative to the frontal direction of the listener. The convolution of the finite impulse response filters (FIRs =binaural room impulse responses) can be done in the time domain, the frequency domain (overlap-save of overlap-add) or in the QMF-filterbank domain (QMR =quadrature mirror filter), see for filter processing structure FIG. 7.

The processed version 126 of the ambient sound portion 110 of the stereo signal processed by the binauralization stage 124 can comprise at least one more channel than the stereo signal. For example, the signal 126 processed by the binauralization stage 124 can comprise three channels (e.g., for a loudspeaker reproduction system comprising three loudspeakers) or four channels (e.g., for a loudspeaker reproduction system comprising four loudspeakers, or for a further processing).

Further, the spatial effect processing stage 104 can comprise a listener envelopment modifier 128 configured to apply listener envelopment binaural filters (or binaural filters adapted to enhance an auditory envelopment (of the listener)) to the ambient portion 110 of the multi-channel signal or a processed version thereof, e.g., to the decorrelated signal 122 in the embodiment shown in FIG. 3.

For the envelopment modifier 128 (or envelopment modification block or envelopment stage) a measurement inside the car measuring impulse responses from loudspeakers behind the listener can be used. In these measurements a dummy head on a torso [Hess, W. and J. Weishäupl, "Replication of Human Head Movements in 3 Dimensions by a Mechanical Joint", in Proc. ICSA International Conference on Spatial Acoustics, Erlangen, Germany, 2014.], a sphere microphone or a baffle [Jecklin, J.: "A different way to record classical music", in J. Audio Eng. Soc, Vol. 29 issue 5 pp., 329-332, 1981] can be used to ensure an audio channel separation of left and right ear measurement channel. In the car, the dummy head or microphone can be placed on the front seat. At each front seat a measurement can be done, so two different binaural room-impulse responses can be measured. One loudspeaker can be measured or a combination of more than one, see FIG. 4. See for the filter processing structure FIG. 7.

The processed version 130 of the ambient sound portion 110 of the stereo signal processed by the envelopment modifier 128 can comprise at least one more channel than the stereo signal. For example, the signal 126 processed by the envelopment modifier 128 can comprise three channels (e.g., for a loudspeaker reproduction system comprising three loudspeakers) or four channels (e.g., for a loudspeaker reproduction system comprising four loudspeakers, or for a further processing).

Furthermore, the spatial effect processing stage 104 can comprise a first delay stage 132_1 configured to delay a processed version of the ambient portion 110 of the stereo signal, e.g., processed by the binauralization stage 124 in the embodiment shown in FIG. 3, and a second delay stage 132_2 configured to delay a processed version of the ambient portion 110 of the stereo signal, e.g., processed by the envelopment modifier 128 in the embodiment shown in FIG. 3, The processed version 134_1 of the ambient sound portion 110 of the stereo signal processed by the first delay stage 132_1 and the processed version 134_2 of the ambient sound portion 110 of the stereo signal processed by the second delay stage 132_4 can each comprise at least one more channel than the stereo signal. For example, the signals 134_1 and 134_2 processed by the first and second delay stage 132_1 and 132_2 can comprise three channels (e.g., for a loudspeaker reproduction system comprising three loudspeakers) or four channels (e.g., for a loudspeaker reproduction system comprising four loudspeakers).

Furthermore, the spatial effect processing stage 104 can comprise an auditory stage dimension effect adjusting stage 136_1 configured to adjust an auditory stage dimension effect strength of a processed version of the ambient portion 110 of the stereo signal, e.g., processed by the binauralization stage 124 or a further processed version thereof, for example, the signal 134_1 processed by the first delay stage 132_1.

The processed version 138_1 of the ambient sound portion 110 of the stereo signal processed by the auditory stage dimension effect adjusting stage 136_1 can comprise at least one more channel than the stereo signal. For example, the signal 138_1 processed by the auditory stage dimension effect adjusting stage 136_1 can comprise three channels (e.g., for a loudspeaker reproduction system comprising three loudspeakers) or four channels (e.g., for a loudspeaker reproduction system comprising four loudspeaker).

Furthermore, the spatial effect processing stage 104 can comprise a listener envelopment effect adjusting stage 136_2 configured to adjust an effect strength of a processed version of the ambient portion 110 of the stereo signal, e.g., processed by the listener envelopment modifier 128 or a further processed version thereof, for example, the signal 134_2 processed by the second delay stage 132_2 in the embodiment shown in FIG. 3.

The processed version 138_2 of the ambient sound portion 110 of the stereo signal processed by the listener envelopment effect adjusting stage 136_2 can comprise at least one more channel than the stereo signal. For example, the signal 138_2 processed by the listener envelopment effect adjusting stage 136_2 can comprise three channels (e.g., for a loudspeaker reproduction system comprising three loudspeakers) or four channels (e.g., for a loudspeaker reproduction system comprising four loudspeaker).

The spatial effect signal 108 provided by the spatial effect stage 104 can be a processed version of the ambient portion 110 of the stereo signal processed by at least one out of the binauralization stage 124 and the listener envelopment modifier 128, and optionally further processed by at least one out of the first delay stage 132_1, second delay stage 132_2, auditory stage dimension effect adjusting stage 136_1 and listener envelopment effect adjusting stage 136_2 or a combination of those signals, for example, a combination of the signals 138_1 and 138_2 processed by the auditory stage dimension effect adjusting stage 136_1 and the listener envelopment effect adjusting stage 136_2 in the embodiment shown in FIG. 3. Caused by the different signal paths, ASD and LEV effect strength can be adjusted independently, so an individual 3-D effect comprising front stage 3-D effect and surrounding (or enveloping from the side and rear) 3-D effect can be tuned.

The sound processor 100 can further comprise a stereo processing stage (front stage generation) 114 configured to generate an individual stereo sound stage signal 112 based on the stereo signal 106 for generating with a loudspeaker reproduction system having three or four loudspeakers at least two individual stereo sound stages for at least two different listening positions, i.e., a driver position and a front passenger position.

The individual stereo sound stage signal 112 provided by the stereo processing stage 114 can comprise at least one more channel than the stereo signal. For example, the individual stereo sound stage signal 112 can comprise three channels (e.g., for a loudspeaker reproduction system comprising three loudspeakers) or four channels (e.g., for a loudspeaker reproduction system comprising four loudspeakers).

The combining stage 116, e.g., adder, can be configured to channel-wise combine the individual stereo sound stage signal 112 and the spatial effect signal 108, i.e., the individual stereo sound stage signal 112 and the spatial effect signal 108 can comprise the same number of channels.

The signal 140 provided by the combining stage 116 can comprise at least one more channel than the stereo signal. For example, the signal 140 provided by the combining stage 116 can comprise three channels (e.g., for a loudspeaker reproduction system comprising three loudspeakers) or four channels (e.g., for a loudspeaker reproduction system comprising four loudspeakers).

The sound processor 100 may comprise a four-channel output generation unit 142 configured to generate a four-channel output signal 144 comprising four channels (left left (LL), left right (LR), right left (RL), right right (RR)) (e.g., for a loudspeaker reproduction system comprising four loudspeakers) based on the signal 140 processed by the combining stage 116.

Alternatively, the sound processor 100 may comprise a three-channel output generation unit 146 configured to generate a three-channel output signal 148 comprising three channels (left (LL), center (CNTR), right (RR)) (e.g., for a loudspeaker reproduction system comprising three loudspeakers) based on the signal 140 processed by the combining stage 116.

Figure 4:
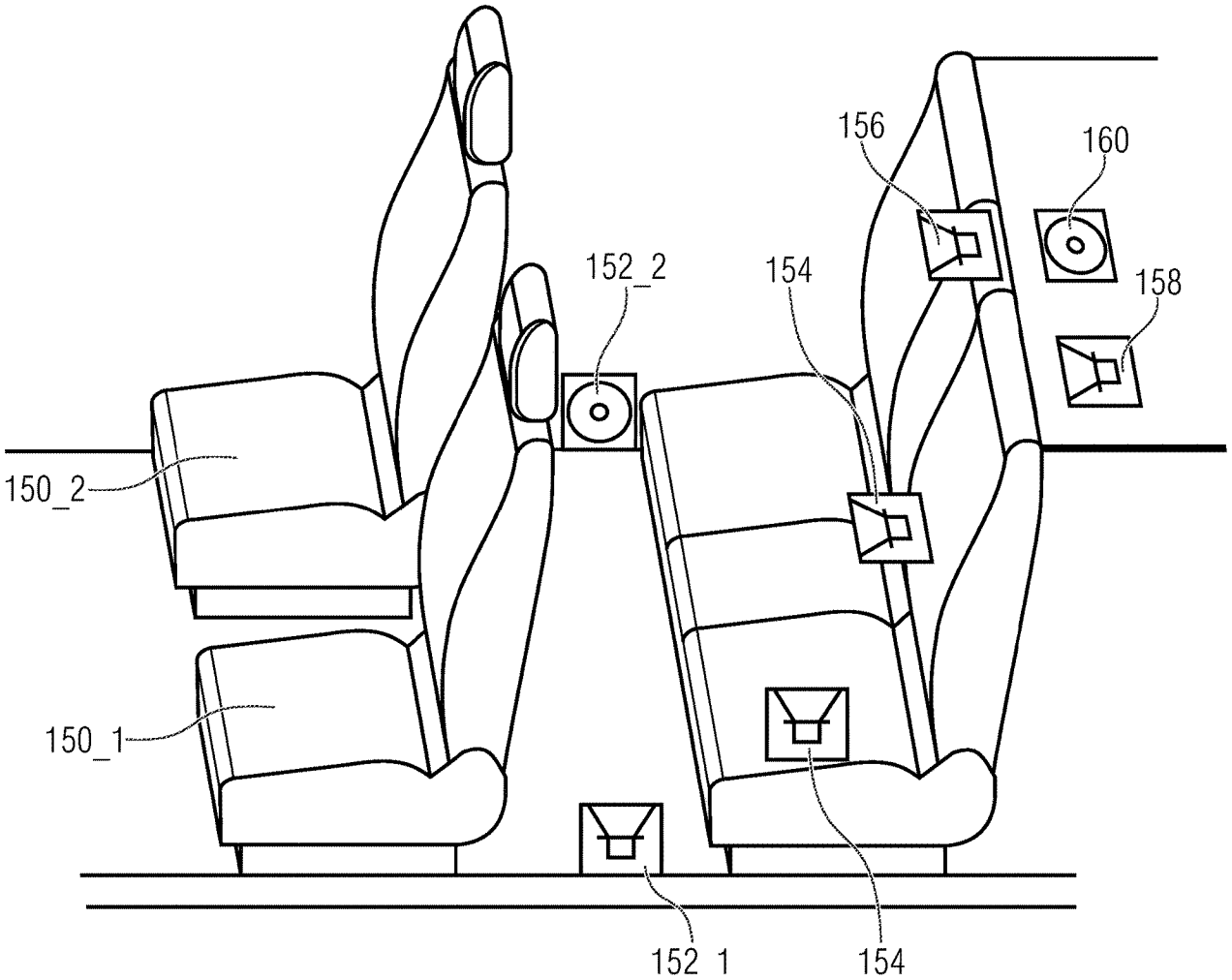
FIG. 4 shows a schematic view of a measurement arrangement for obtaining the binaural filters of the listener envelopment modifier, according to an embodiment.

FIG. 4 shows a schematic view of a measurement arrangement for obtaining the binaural filters of the listener envelopment modifier, according to an embodiment.

In other words, FIG. 4 shows a measurement of the filters (FIRs=binaural room impulse responses) for listener envelopment (LEV) path. The dummy head can placed on one of the front seats 150_1 and 150_2.

As depicted in FIG. 4, for the measurements loudspeakers behind the front seats 150_1 and 150_2 can be used for the measurement process. In the vehicle back doors 152_1 and 152_2, placed at the rear seats 154 radiating sideward, to the front or upwards, placed on top of the backrest of the rear seats 156, placed on top of the rear shelf 158 radiating to the front or the back, placed in the rear shelf or on top of it 160 radiating upwards.

Figure 5:
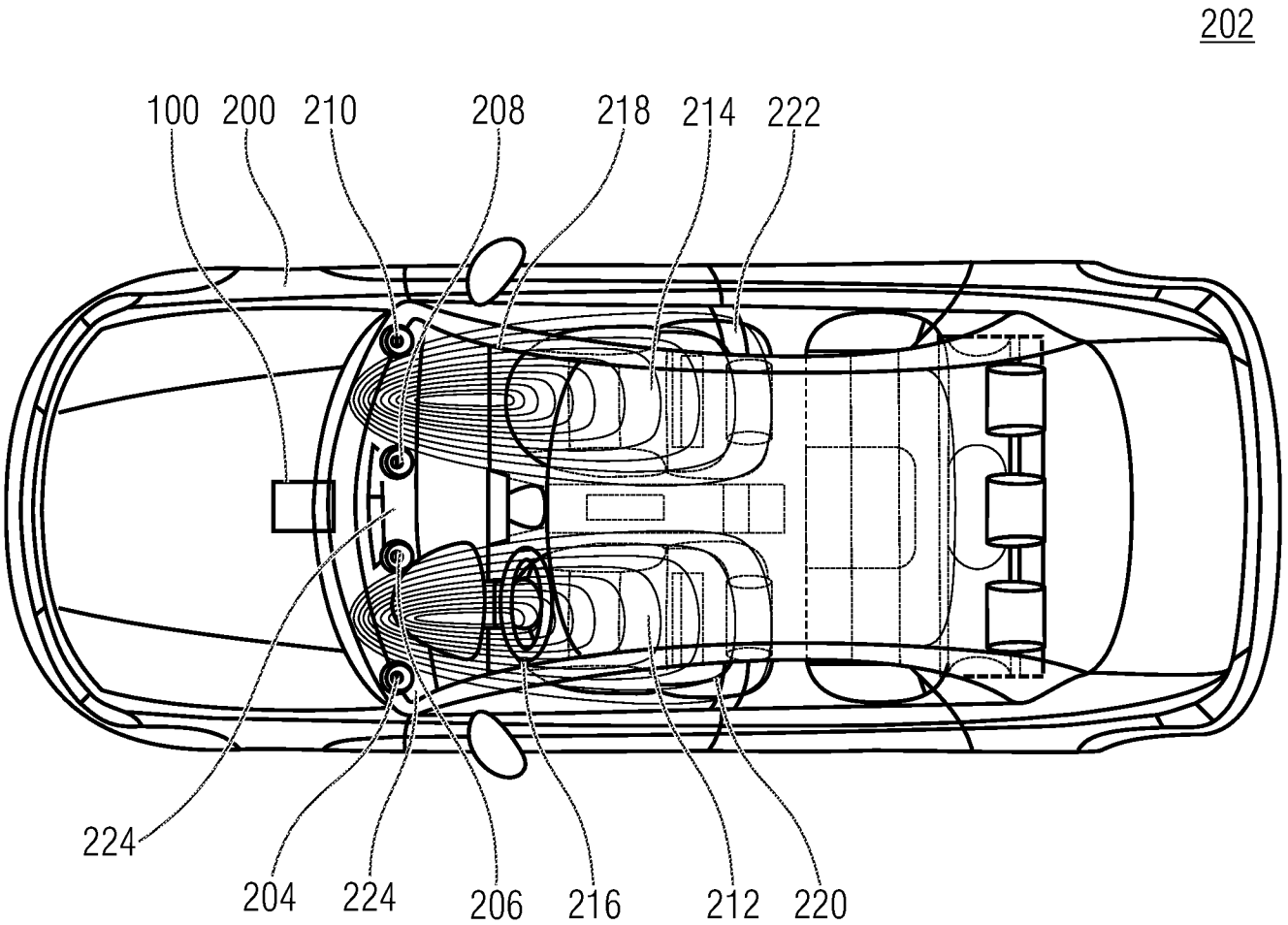
FIG. 5 shows a schematic top-view of a vehicle with a loudspeaker reproduction system comprising a digital processor and four loudspeakers, according to an embodiment.

FIG. 5 shows a schematic top-view of a vehicle 200 with a loudspeaker reproduction system 202 comprising the digital processor 100 and four loudspeakers 204, 206, 208, 210.

The loudspeaker reproduction system 200 can be configured to reproduce the signal processed by the digital processor 100, e.g., the signal provided by the four channel generation output unit 142, using the four loudspeakers 204, 206, 208, 210. Thereby, each of the loudspeakers 204, 206, 208, 210 can be used to reproduce one of the channels of the signal processed by the digital processor 100.

Each of the loudspeakers 204, 206, 208, 210 can comprise one loudspeaker driver (e.g., a full-range driver or wide-range driver) or a plurality of loudspeaker drivers for different frequency bands (e.g., a high-frequency driver (tweeter) and mid-frequency driver; a high-frequency driver (tweeter) and a woofer; or a high-frequency driver (tweeter), a mid-frequency driver and a woofer).

The two loudspeakers 204 and 206 can be directed towards a first listening position (e.g., driver position) 212 and can be used to reproduce right and left channels of a stereo front stage by generating a first sound field 216 for the first listening position 212, wherein the two loudspeakers 208 and 210 can be directed towards a second listening position (e.g., front passenger position) 214 and can be used to reproduce right and left channels of a stereo front stage by generating a second sound field 218 for the second listening position 214.

As exemplarily shown in FIG. 5, the vehicle 200 can be a car. The car may at least comprise a driver seat 220 and a front passenger seat 222. Thereby, a driver position 212 may be defined by a position of the driver seat 220, wherein a front passenger position 214 may be defined by a position of the front passenger seat 222. For example, the driver position 212 may correspond to (or be) a position in which a head of a driver that is sitting on the driver seat 220 would be arranged. Similarly, the front passenger position 214 may correspond to (or be) a position in which a head of a front passenger that is sitting on the front passenger seat 222 would be arranged.

Naturally, the car may further comprise at least two rear seats or at least one rear bench seat for at least two more passengers. As becomes obvious from FIG. 5, in that case, first and second sound fields 216 and 218 are also directed towards rear passenger positions arranged behind the driver and front passenger positions 212 and 214, e.g. towards rear passengers who are sitting behind the driver (seat) and front passenger (seat), respectively. Also at the seats behind driver and front passenger, the virtual 3-D sound signal may be perceivable, since the position to the sound presenting loudspeakers is also symmetrical like on the front seat, however the distance is larger. Both seats are in a row with regard to the loudspeaker system in front.

The loudspeakers 204, 206, 208, 210 can be arranged, for example, in a dashboard 224 of the vehicle 200.

In other words, FIG. 5 shows listening rows in the vehicle, example is shown using four loudspeakers in the dashboard. The two central loudspeakers can also be replaced by one central loudspeaker.

Figure 6:
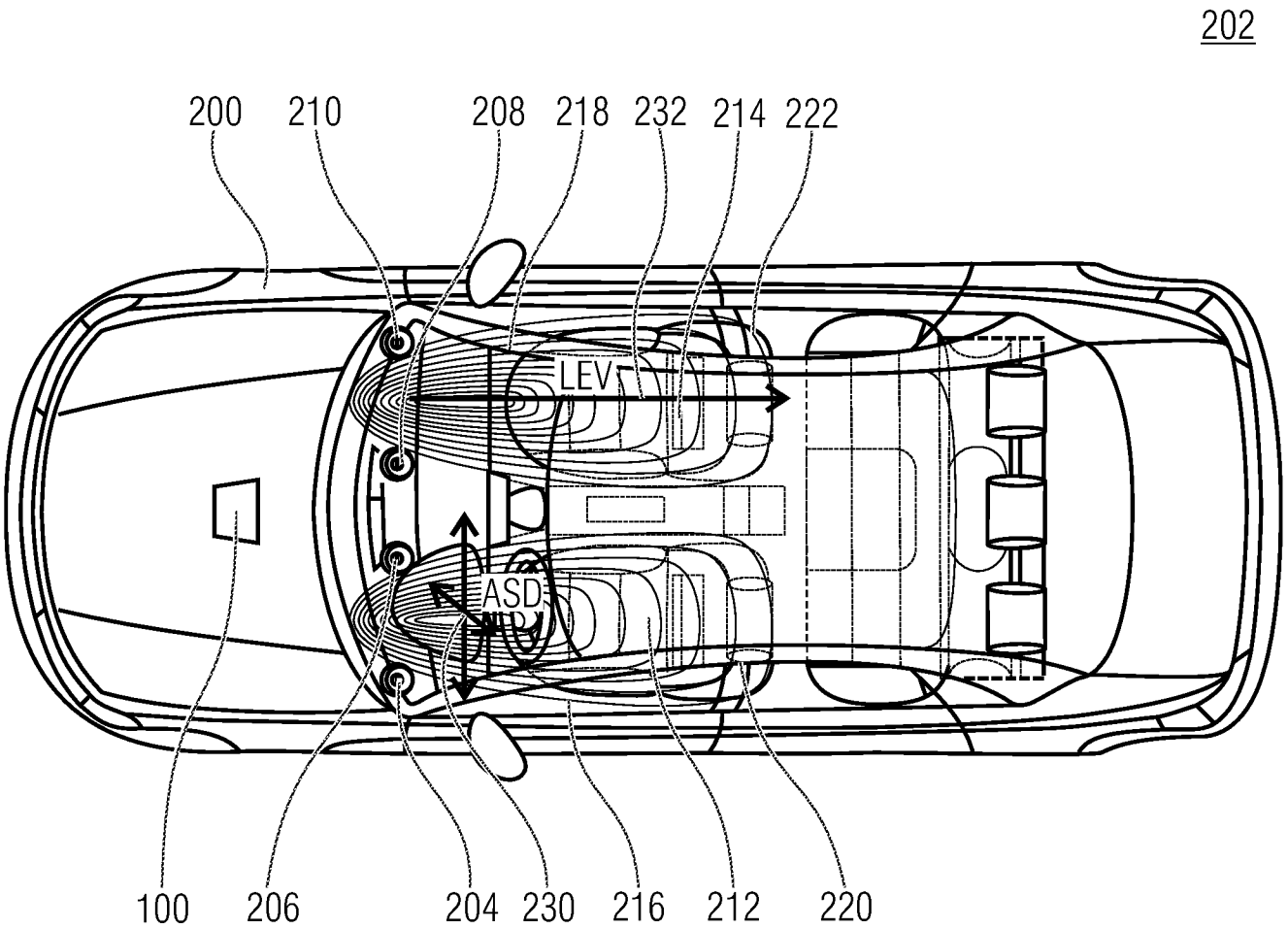
FIG. 6 shows a schematic top-view of the vehicle with the loudspeaker reproduction system shown in FIG. 5 further indicating auditory stage dimension and listener envelopment.

FIG. 6 shows a schematic top-view of a vehicle 200 with the loudspeaker reproduction system 202 shown in FIG. 5. In Addition to FIG. 5, in FIG. 6 auditory stage dimension and listener envelopment are indicated by arrows 230 and 232 respectively. In other words, FIG. 6 shows three-dimensional audio. ASD and LEV auditory spatial dimension, ASD (auditory stage dimension) for frontal width and height, LEV for spatial depth.

Figure 7:
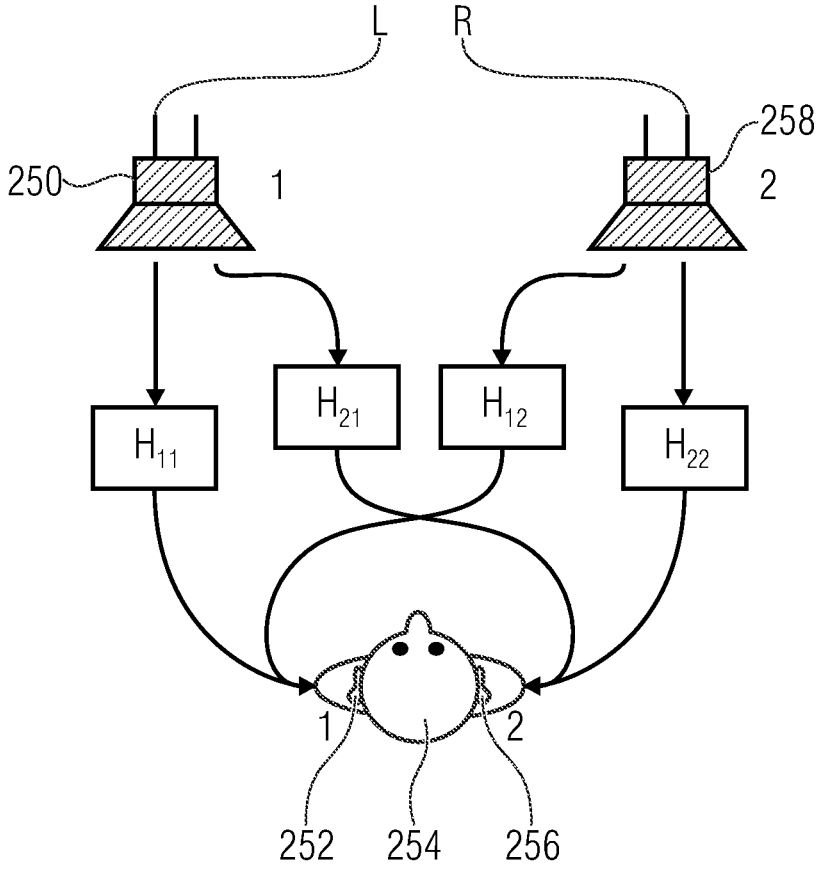
FIG. 7 shows a schematic view of a filter processing structure of binauralization and envelopment modification stages of the spatial effect processing stage.

FIG. 7 shows a schematic view of a filter processing structure of binauralization and envelopment modification stages of the spatial effect processing stage. A first sound path between a first sound source (e.g., first loudspeaker) 250 and a first ear 252 of a listener 254 can be described by coefficient $H_{11}$, a second sound path between the first sound source 250 and a second ear 256 of the listener 254 can be described by coefficient $H_{21}$, a third sound path between a second sound source (e.g., second loudspeaker) 258 and the first ear 252 of the listener can be described by coefficient $H_{12}$, and a fourth sound path between the second sound source 258 and the second ear 256 of the listener 254 can be described by coefficient $H_{22}$.

Figure 8:
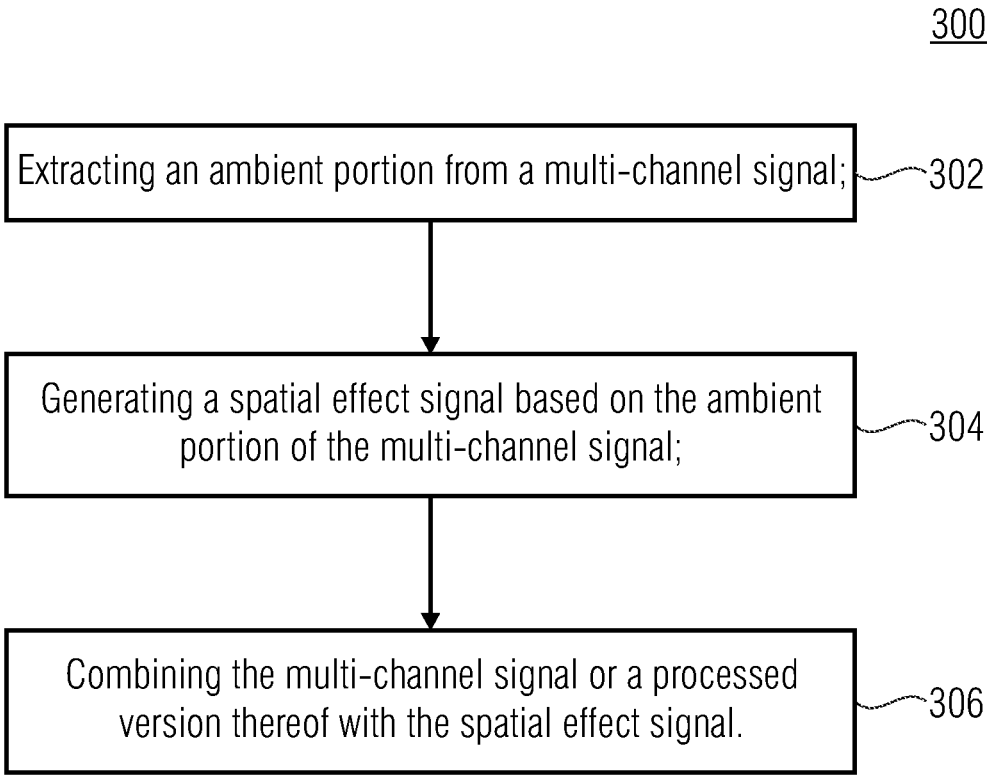
FIG. 8 shows a flow-chart of a method for processing a signal, according to an embodiment.

FIG. 8 shows a flow-chart of a method 300 for processing a signal, according to an embodiment. The method 300 comprises a step 302 of extracting an ambient portion from a multi-channel signal; a step 304 of generating a spatial effect signal based on the ambient portion of the multi-channel signal; and a step 306 of combining the multi-channel signal or a processed version thereof with the spatial effect signal.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A digital processor for a loudspeaker reproduction system with at least three front loudspeakers, comprising:

an ambient portion extractor configured to extract an ambient portion from a multi-channel signal; and a spatial effect processing stage, configured to generate a spatial effect signal based on the ambient portion of the multi-channel signal;

wherein the digital processor is configured to combine a processed version of the multi-channel signal with the spatial effect signal, to acquire a signal for the at least three front loudspeakers;

wherein the digital processor comprises a multi-channel processing stage configured to generate the processed version of the multi-channel signal;

wherein the digital processor is configured to combine the processed version of the multi-channel signal and the spatial effect signal;

wherein the multi-channel signal is a stereo signal; and wherein the processed version of the multi-channel signal comprises at least one more channel than the multi-channel signal;

wherein the multi-channel processing stage is configured to generate at least two individual stereo sound stage signals as the processed version of the multi-channel signal from the stereo signal for generating with the loudspeaker reproduction system comprising the at least three loudspeakers at least two individual stereo sound stages for at least two different listening positions.

2. The digital processor according to claim 1, wherein the spatial effect processing stage comprises a binauralization stage configured to apply spatial binaural filters to the ambient portion of the multi-channel signal or a processed version thereof.

3. The digital processor according to claim 2, wherein the spatial binaural filters of the binauralization stage correspond to binaural direct sound path impulse responses.

4. The digital processor according to claim 2, wherein the binauralization stage is configured to apply the same binaural filters to channels of the ambient portion of the multi-channel signal or the processed version thereof corresponding to different listening positions.

5. The digital processor according to claim 1, wherein the spatial effect processing stage comprises a listener envelopment modifier configured to apply listener envelopment binaural filters to the ambient portion of the multi-channel signal or a processed version thereof.

6. The digital processor according to claim 5, wherein the listener envelopment binaural filters of the listener envelopment modifier correspond to binaural room impulse responses.

7. The digital processor according to claim 5, wherein the listener envelopment modifier is configured to apply different binaural filters to channels of the ambient portion of the multi-channel signal or the processed version thereof corresponding to different listening positions.

8. The digital processor according to claim 1, wherein the spatial effect processing stage comprises a decorrelator configured to decorrelate the ambient portion of the multi-channel signal, to acquire a decorrelated signal;

wherein the spatial effect processing stage comprises a binauralization stage configured to apply spatial binaural filters to the ambient portion of the multi-channel signal or a processed version thereof;

wherein the binauralization stage is configured to apply the spatial binaural filters to the decorrelated signal or a processed version thereof.

9. The digital processor according to claim 8, wherein the decorrelated signal comprises at least one more channel than the multi-channel signal.

10. The digital processor according to claim 1, wherein the spatial effect processing stage comprises a binauralization stage configured to apply spatial binaural filters to the ambient portion of the multi-channel signal or a processed version thereof;

wherein the spatial effect processing stage comprises a delay stage configured to delay a signal processed by the binauralization stage or a further processed version thereof.

11. The digital processor according to claim 1, wherein the spatial effect processing stage comprises a binauralization stage configured to apply spatial binaural filters to the ambient portion of the multi-channel signal or a processed version thereof;

wherein the spatial effect processing stage comprises a listener envelopment modifier configured to apply listener envelopment binaural filters to the ambient portion of the multi-channel signal or a processed version thereof;

wherein the binauralization stage and the listener envelopment modifier are connected in series;

wherein the spatial effect processing stage comprises a spatial effect strength adjusting stage configured to adjust a spatial effect strength provided by the serial connection of the binauralization stage and the listener envelopment modifier.

12. The digital processor according to claim 1, wherein the spatial effect processing stage comprises a binauralization stage configured to apply spatial binaural filters to the ambient portion of the multi-channel signal or a processed version thereof;

wherein the spatial effect processing stage comprises a listener envelopment modifier configured to apply listener envelopment binaural filters to the ambient portion of the multi-channel signal or a processed version thereof;

wherein the binauralization stage and the listener envelopment modifier are connected in parallel;

wherein the spatial effect processing stage comprises an auditory stage dimension effect adjusting stage configured to adjust an effect strength of a signal processed by the binauralization stage or a further processed version thereof;

wherein the spatial effect processing stage comprises a listener envelopment effect adjusting stage configured to adjust an effect strength of a signal provided by the listener envelopment modifier or a further processed version thereof.

13. The digital processor according to claim 1, wherein the digital processor is configured to channel wise combine the multi-channel signal or the processed version thereof with the spatial effect signal.

14. The digital processor according to claim 1, wherein the digital processor comprises an adder, configured to channel wise add the multi-channel signal or the processed version thereof with the spatial effect signal.

15. A loudspeaker reproduction system for a vehicle, the system comprising:

a digital processor according to claim 1;

at least three front loudspeakers configured to reproduce a signal acquired by the combining of the multi-channel signal or the processed version thereof and the spatial effect signal.

16. The digital processor according to claim 1, wherein the spatial effect processing stage comprises a decorrelator configured to decorrelate the ambient portion of the multi-channel signal, to acquire a decorrelated signal;

wherein the spatial effect processing stage comprises a listener envelopment modifier configured to apply listener envelopment binaural filters to the ambient portion of the multi-channel signal or a processed version thereof;

wherein the listener envelopment modifier is configured to apply the envelopment binaural filters to the decorrelated signal or a processed version thereof.

17. The digital processor according to claim 16, wherein the decorrelated signal comprises at least one more channel than the multi-channel signal.

18. The digital processor according to claim 1, wherein the spatial effect processing stage comprises a listener envelopment modifier configured to apply listener envelopment binaural filters to the ambient portion of the multi-channel signal or a processed version thereof;

wherein the spatial effect processing stage comprises a delay stage configured to delay a signal processed by the listener envelopment modifier according or a further processed version thereof.

19. A method for processing signals for a loudspeaker reproduction system with at least three front loudspeakers, the method comprising:

extracting an ambient portion from a multi-channel signal; and generating a spatial effect signal based on the ambient portion of the multi-channel signal; and generating a processed version of the multi-channel signal;

combining the processed version of the multi-channel signal with the spatial effect signal, to acquire a signal for the at least three front loudspeakers;

wherein the multi-channel signal is a stereo signal;

wherein the processed version of the multi-channel signal comprises at least one more channel than the multi-channel signal; and wherein generating the processed version of the multi-channel signal comprises generating at least two individual stereo sound stage signals as the processed version of the multi-channel signal from the stereo signal for generating with the loudspeaker reproduction system comprising the at least three loudspeakers at least two individual stereo sound stages for at least two different listening positions.

20. A non-transitory digital storage medium having a computer program stored thereon to perform the method for processing signals for a loudspeaker reproduction system with at least three front loudspeakers, the method comprising:

extracting an ambient portion from a multi-channel signal; and generating a spatial effect signal based on the ambient portion of the multi-channel signal; and generating a processed version of the multi-channel signal;

combining the processed version of the multi-channel signal with the spatial effect signal, to acquire a signal for the at least three front loudspeakers;

wherein the multi-channel signal is a stereo signal;

wherein the processed version of the multi-channel signal comprises at least one more channel than the multi-channel signal; and wherein generating the processed version of the multi-channel signal comprises generating at least two individual stereo sound stage signals as the processed version of the multi-channel signal from the stereo signal for generating with the loudspeaker reproduction system comprising the at least three loudspeakers at least two individual stereo sound stages for at least two different listening positions, when said computer program is run by a computer.

* * * * *